US005205627A

United States Patent [19]

Davison et al.

[11] Patent Number: 5,205,627

[45] Date of Patent: Apr. 27, 1993

[54] MODULAR ANTI-TIP LATERAL MOBILE STORAGE SYSTEM

[75] Inventors: Thomas R. Davison; Philip M. Croel; Alan R. Leist, all of Grand Rapids, Mich.

[73] Assignee: Ripp Mobile System, Inc., Grand Rapids, Mich.

[21] Appl. No.: 670,187

[22] Filed: Mar. 14, 1991

[51] Int. Cl.[5] ..... A47B 53/00

[52] U.S. Cl. ..... 312/201; 312/198

[58] Field of Search ..... 312/198, 201

[56] References Cited

U.S. PATENT DOCUMENTS

| | | | |
|---|---|---|---|
| 2,000,463 | 5/1935 | Browne . | |
| 2,046,095 | 6/1936 | Shaw | 312/111 |
| 4,084,125 | 4/1978 | King | 312/201 |
| 4,467,924 | 8/1984 | Morcheles . | |
| 4,597,615 | 7/1986 | Steger . | |
| 4,708,411 | 11/1987 | Peterman . | |
| 4,771,901 | 9/1988 | Griswold et al. . | |
| 4,789,210 | 12/1988 | Weiss et al. . | |
| 4,911,507 | 3/1990 | Leist . | |
| 4,944,231 | 7/1990 | Leist . | |
| 5,062,535 | 11/1991 | Potter | 312/201 |

FOREIGN PATENT DOCUMENTS

| | | | |
|---|---|---|---|
| 0225858 | 6/1987 | European Pat. Off. . | |
| 0222834 | 1/1962 | Fed. Rep. of Germany | 312/201 |
| 866206 | 5/1987 | United Kingdom . | |

OTHER PUBLICATIONS

Advertising entitled "Tab Side-Trac Mobile Cabinet System", Tab Products Co., bearing dates of May 1988 and May 1990.

Drawing entitled "Classic Track Lateral System".

*Primary Examiner*—Kenneth J. Dorner

*Assistant Examiner*—Gerald A. Anderson

*Attorney, Agent, or Firm*—Warner, Norcross & Judd

[57] ABSTRACT

A lateral mobile storage system is disclosed in which the weight of the rear, fixed storage unit rests upon the foot of an anti-tip underlayment. The anti-tip underlayment has an arm extending forwardly upon which rests the rear track for the mobile storage unit held in correct alignment thereby with the fixed storage unit. The mobile storage unit carriage includes a rearwardly extending finger which engages a retainer on the anti-tip underlayment to prevent the mobile storage unit from tipping forwardly. The components are provided in modular lengths and need not be affixed to the floor.

22 Claims, 5 Drawing Sheets

MODULAR ANTI-TIP LATERAL MOBILE STORAGE SYSTEM

BACKGROUND OF THE INVENTION

1. Field of the Invention

The present invention relates to a mobile storage system including an anti-tip construction for preventing tipping of the individual mobile storage units. More particularly, the invention relates to such a system for modular, laterally oriented mobile storage 2. Description of the Related Art Mobile storage systems are known in which storage units are supported on wheels or rollers and travel along tracks. The storage units are easily moved, enabling multiple units to be closely spaced with access to a particular unit gained by moving certain units out of the way. In lateral storage systems, the direction of travel of the storage units is parallel to the length of the storage units. Rows of storage units are closely spaced front to back. A rearward unit is accessed by rolling one or more forward units to the side to expose the rearward unit.

However, without the provision of an anti-tip arrangement, these mobile systems are subject to certain governmental safety restrictions. More specifically, OSHA regulations prohibit mobile storage units without an anti-tipping arrangement from exceeding a height-to-width ratio of 4 to 1.Accordingly, a typical two foot wide storage unit is limited to a height of eight feet. Furthermore, the California Seismic Safety Authority has ruled that all mobile storage systems installed in California must include anti-tip systems due to the additional hazards caused by earthquakes.

A common type of anti-tip system involves the use of upper bracing systems which fixedly mount to the ceiling, an adjacent wall, or on columns extending up from the floor. These bracing systems are coupled with the upper portions of the storage units to prohibit their tipping. This type of arrangement, however, is complex, expensive to fabricate and install, and produces an unsightly appearance. Moreover, one must additionally verify that the ceiling, wall, or columns are sufficiently strong to resist the extra loads imposed.

Another type of anti-tip system is that manufactured and sold by Kardex, Inc. which includes specially designed carriages and carriage tracks. More particularly, the carriage tracks have raised outer edges which define narrow grooves with the floor. The carriages have cooperating L-shaped flanges which are received within the defined groove to prevent the shelving units from tipping over. Although this arrangement eliminates many of the above-mentioned shortcomings, such a system still includes several problems. More particularly, large stresses are generated within the track to offset the great moment forces invariably produced by the tipping. Accordingly, the carriage tracks must be extremely strong and rigid to sufficiently offset the risk of structural failure. Additionally, these anti-tip systems cannot be readily retrofitted to existing mobile storage systems.

Yet another type of anti-tip system is disclosed in U.S. Pat. No. 4,911,507 to Leist, and entitled MOBILE STORAGE SYSTEM WITH ANTI-TIP CONSTRUCTION, which uses a separate retainer track affixed to the floor parallel to a nearby shelf track. The retainer track is generally Z-shaped with a horizontal flange spaced above the floor and forming a recess therebetween. An L-shaped retainer flange is affixed to the shelf carriage and has a horizontal finger extending into the recess. The retainer prevents the flange from lifting, thereby preventing the shelf unit from tipping. While this system satisfies some of the aforementioned shortcomings, it has certain drawbacks. Often the floor will be made of concrete and special tools and skills will be required to affix the retainer track to the floor.

Therefore, there is an unmet need for an anti-tip mobile storage system that is retrofittable to existing storage systems yet easily installed in proper alignment.

SUMMARY OF THE INVENTION

The present invention satisfies the aforementioned unmet need by providing a modular mobile storage system having at least one fixed storage unit, at least one mobile storage unit, and an anti-tip underlayment held to the floor by the weight of the fixed storage unit. The anti-tip underlayment has a rearwardly extending foot upon which rests the fixed storage unit, a forwardly extending arm upon which rests one of the tracks of the mobile storage unit, and a retainer flange forming a recess opening toward the mobile storage unit. The carriage of the mobile storage unit is provided with a carriage rail retainer having a finger which extends into the recess. The track for the mobile storage unit nearest the fixed storage units rests atop the underlayment arm and is held in proper alignment with the retainer flange thereby. When the mobile storage unit is tipped away from the fixed storage unit, the retainer finger contacts the retainer flange. The weight of the fixed storage unit on the retainer foot prevents the mobile storage unit from tipping over.

The anti-tip underlayment rests upon the floor without the need for screws or other fasteners. The system is self-aligning in that the track for the mobile storage unit is held parallel to the fixed storage unit at the correct distance by the anti-tip underlayment. Each of the components of the system may be modular by having their lengths corresponding to integral multiples of the lengths of the storage units. Thus, no special skills or tools are needed for installation of the system.

These and other objects, advantages, and features of the present invention will be more fully understood and appreciated by reference to the written specification and appended drawings.

DESCRIPTION OF THE PREFERRED EMBODIMENT

Figure 1:
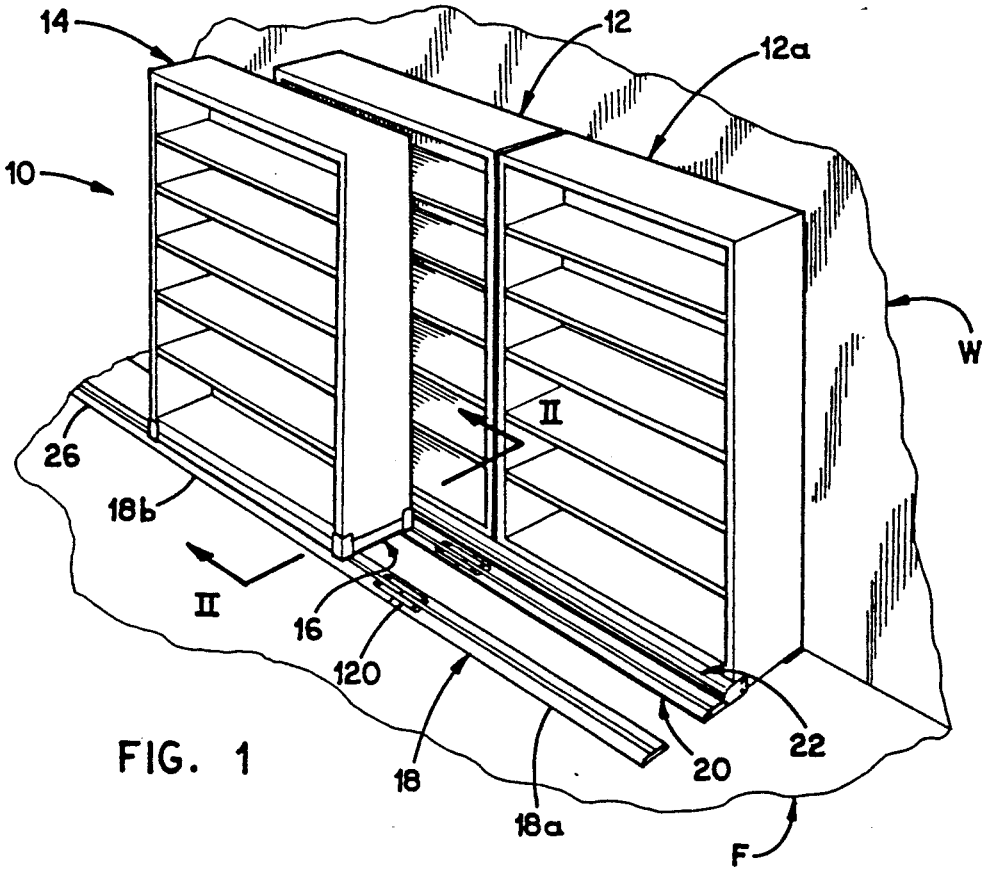
FIG. 1 is a perspective view of a modular anti-tip lateral mobile storage system according to the principles of the invention.

By way of disclosing a preferred embodiment, and not by way of limitation, there is shown in FIG. 1 a modular anti-tip lateral mobile storage system 10 installed as a mobile shelving system which includes in its general organization two fixed shelving units 12, 12*a*, a mobile shelving unit 14 resting on a rolling carriage 16, forward and rear tracks 18, 20, and anti-tip underlayment 22. The fixed shelving units are installed with their backs against or near a room wall W. The mobile shelving unit 14 is installed above the tracks 18, 20 with its back adjacent to and spaced forwardly from the front of the fixed shelving units 12, 12*a*. The shelving units and the tracks are installed with their lengthwise extents generally parallel to the wall W.

As used herein, terms such as "front", "back", "forward", and "rearward" are used to describe the orientations of the components of the shelving system relative to one another. Such usage is not to be taken as limiting the scope of the invention to any particular orientation within a room. Storage systems such as disclosed herein are generally referred to as "lateral" systems inasmuch the shelves extend from side to side relative to a user facing the shelving units. However, the term "longitudinal" as used herein refers to the direction generally parallel to the width of the units, the length of the shelves, and the direction in which the mobile units move.

Normally, an installation of the shelving system will include at least two fixed shelving units, or a single fixed shelving unit longer than the mobile shelving unit, such that it is necessary to move the mobile shelving unit along the tracks to gain access to the fixed shelving units. An installation may also include more than one mobile shelving unit movable on the same pair of tracks. For purposes of illustration, FIG. 1 shows the end 26 of track 18 extending beyond the far end of fixed shelving unit 12 and mobile shelving unit 14 positioned on the tracks beyond the far end of fixed shelving unit 12. However, it should be understood that in a usual installation the tracks 18 and 20 will be substantially coextensive with the combined lengths of the fixed shelving units. It should also be understood that storage units other than shelving units may be used, such as filing cabinets or racks.

Figure 2:
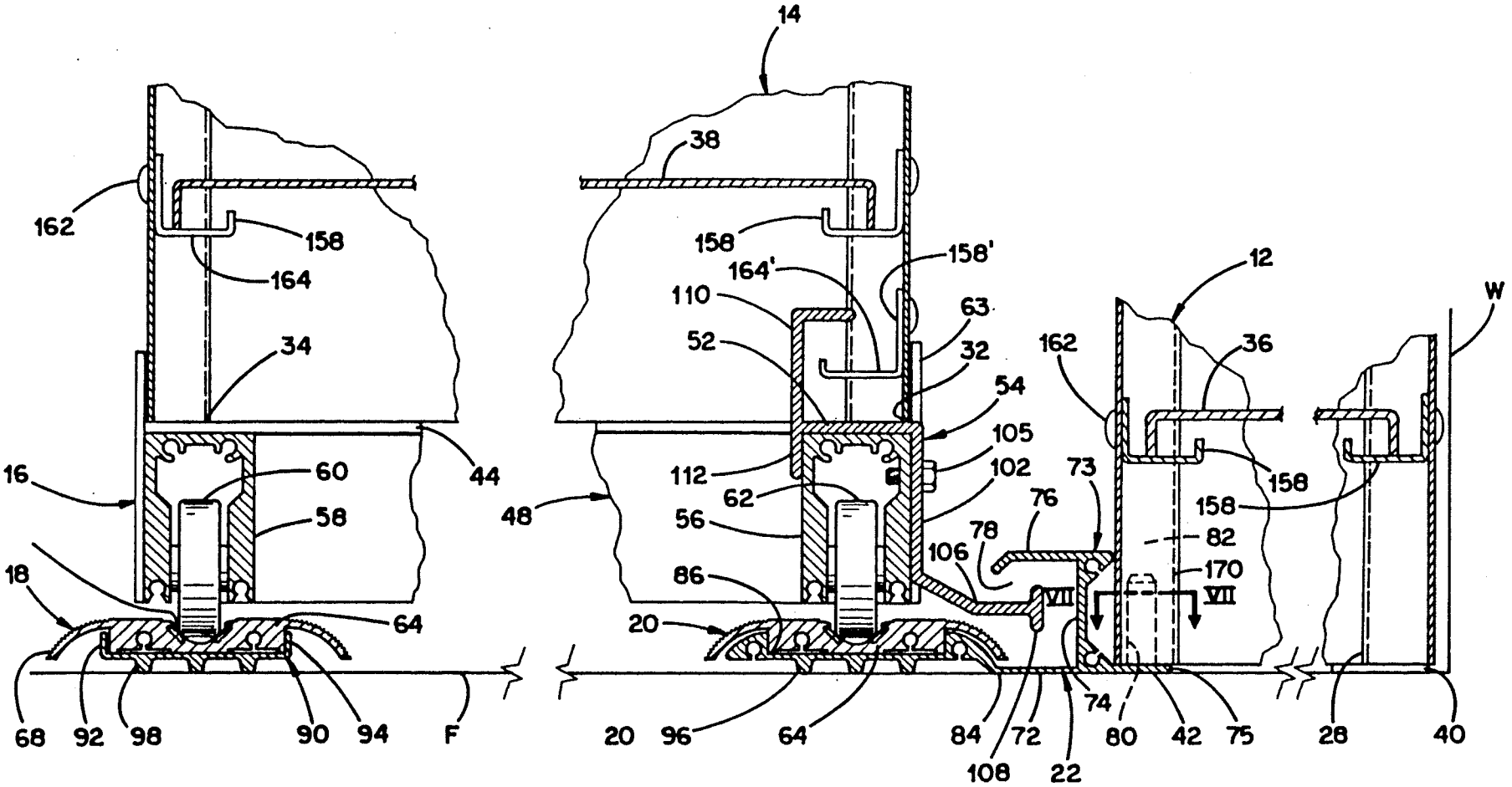
FIG. 2 is a sectional view taken along the line II—II of FIG. 1.

Referring to FIG. 2, it may be seen that the fixed shelving unit 12 and the mobile shelving unit 14 are substantially identical having bottom supports 28, 30 and 32, 34, respectively, and several shelves 36 and 38. Front and rear edges of the shelves are supported on shelf brackets 158. Each shelf bracket includes a supporting ledge 164 and a pin having an enlarged head 162 engaging a keyhole slot formed in a front or rear wall of the shelving units.

The rear bottom support 28 of fixed shelving unit 12 rests upon a shim 40 and the front bottom support 30 rests upon foot 42 of anti-tip underlayment 22 in a manner described more fully below. The bottom supports 32, 34 of mobile shelving unit 14 rest upon the upper flanges 44, 46 (FIG. 4) of the cross rails 48, 50 of the carriage 16. The rearward support 32 of the mobile shelving unit also rests atop the horizontal wall portion 52 of the carriage rail retainer 54 which surmounts the rear longitudinal rail 56.

Figure 4:
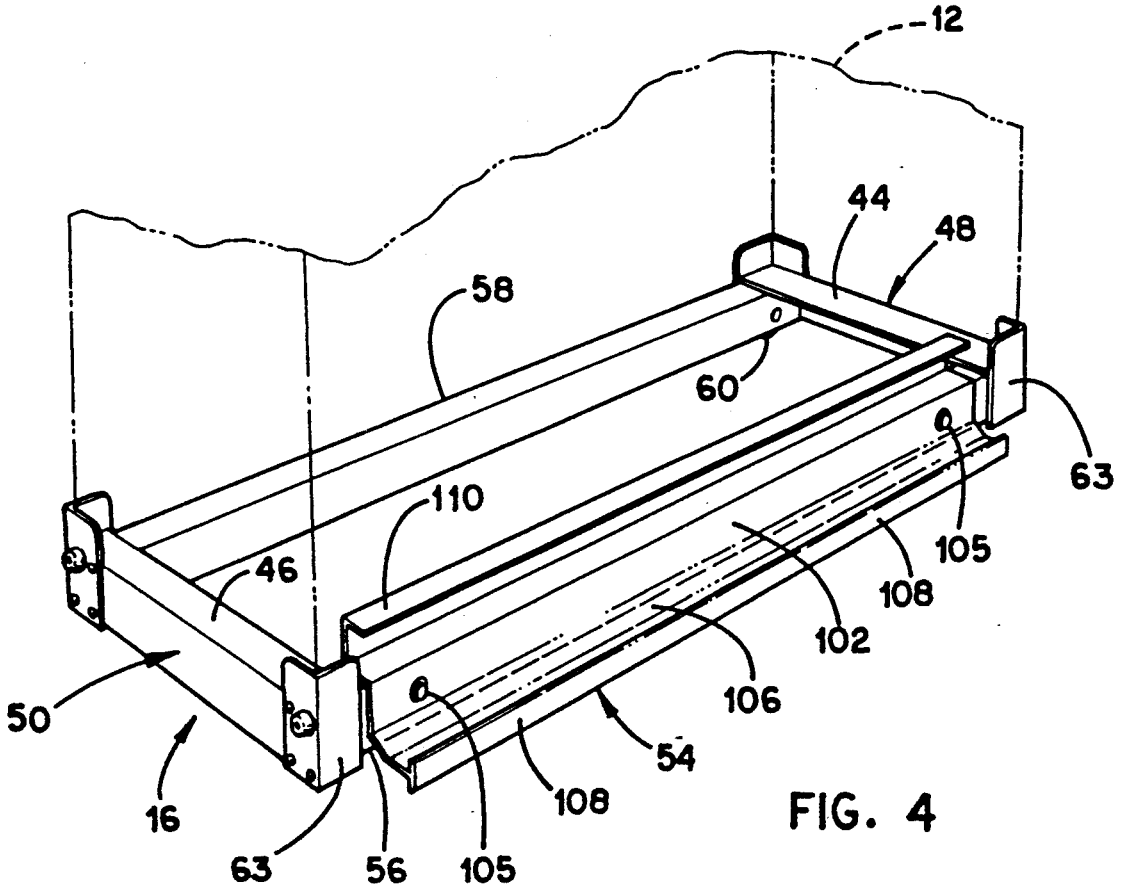
FIG. 4 is a perspective view of a storage unit carriage.

As shown in FIGS. 2 and 4, in known fashion, rear and front longitudinal rails 56, 58 of the carriage 16 extend parallel to each other between the cross rails 48, 50 thus forming a rectangular framework of substantially the same size and shape as the shelving unit 12. The longitudinal rails 56, 58 are formed as downwardly opening channels. At each end of the rails 56, 58, a roller such as rollers 60, 62 is mounted for rotation within the recess of the channels. Corner angles 63 serve to align and retain the shelving unit in proper position atop the carriage.

Figure 5:
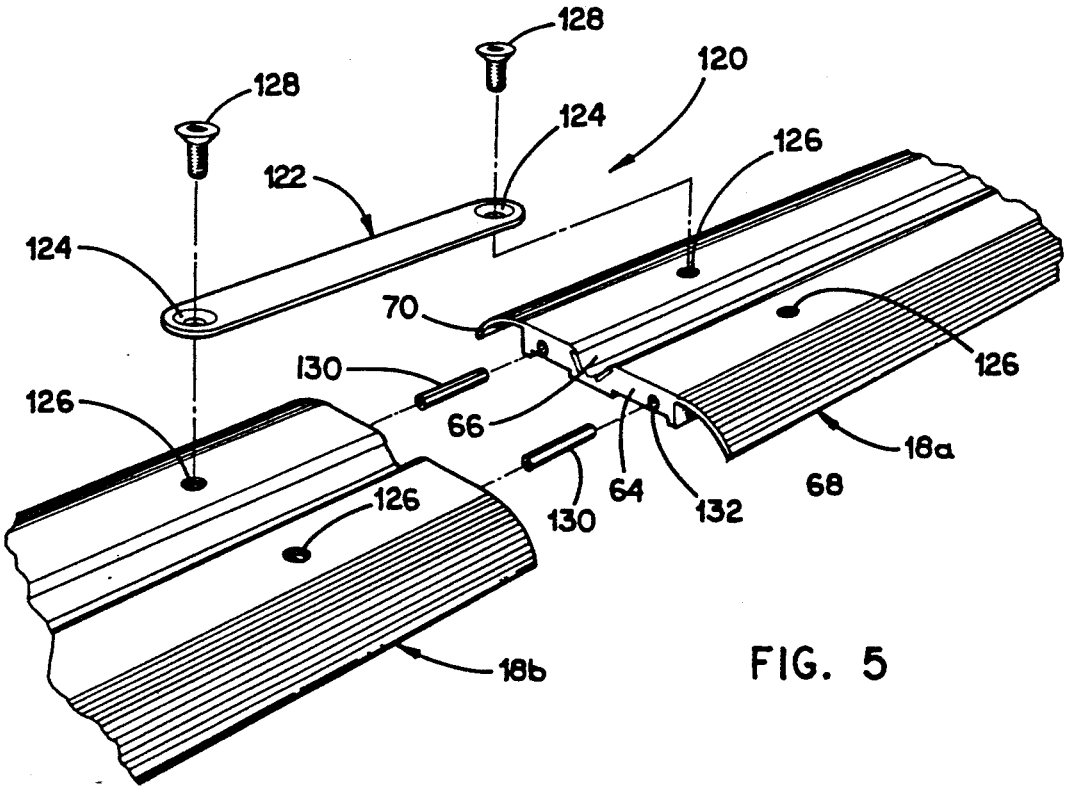
FIG. 5 is an exploded, fragmentary, perspective view showing a splice between track section ends.

The rollers project downwardly beyond the lower extent of the rails 56, 58 and rollingly engage the tracks 18, 20. In known fashion, as shown in FIGS. 2 and 5, each track comprises an elongated central body 64, a longitudinal central groove along which the rollers travel and are guided, and side flanges which extend curving outwardly and downwardly from the upper extent of the longitudinal edges of the central body 64.

Figure 3:
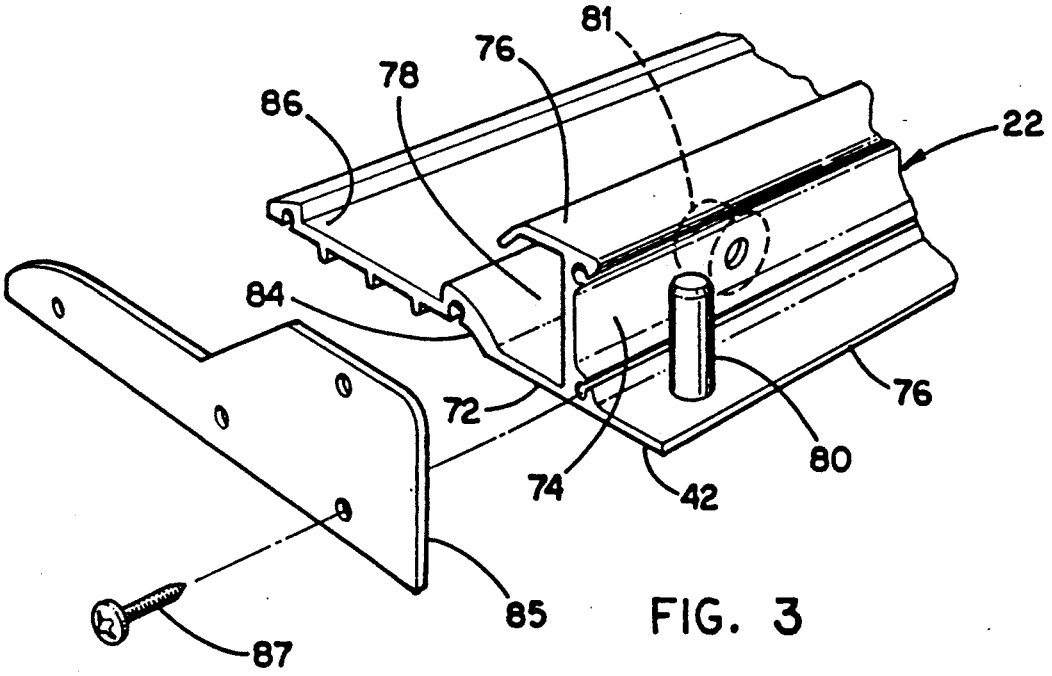
FIG. 3 is an exploded, fragmentary, perspective view of an end of the anti-tip underlayment.

Referring now to FIGS. 2 and 3, it may be seen that the anti-tip underlayment 22 comprises an unitary elongated member, preferably of extruded aluminum, formed with a generally flat base 72, an anti-tip retainer 73 including a generally vertical wall 74 extending upwardly from the base disposed forwardly of the rear longitudinal edge 75 of the base 72 and a retainer flange 76 extending forwardly from the upper edge of the vertical wall 74. A longitudinal, forwardly-opening recess 78 is thus formed between the retainer flange 76 and the base 72.

Figures 6, 7:
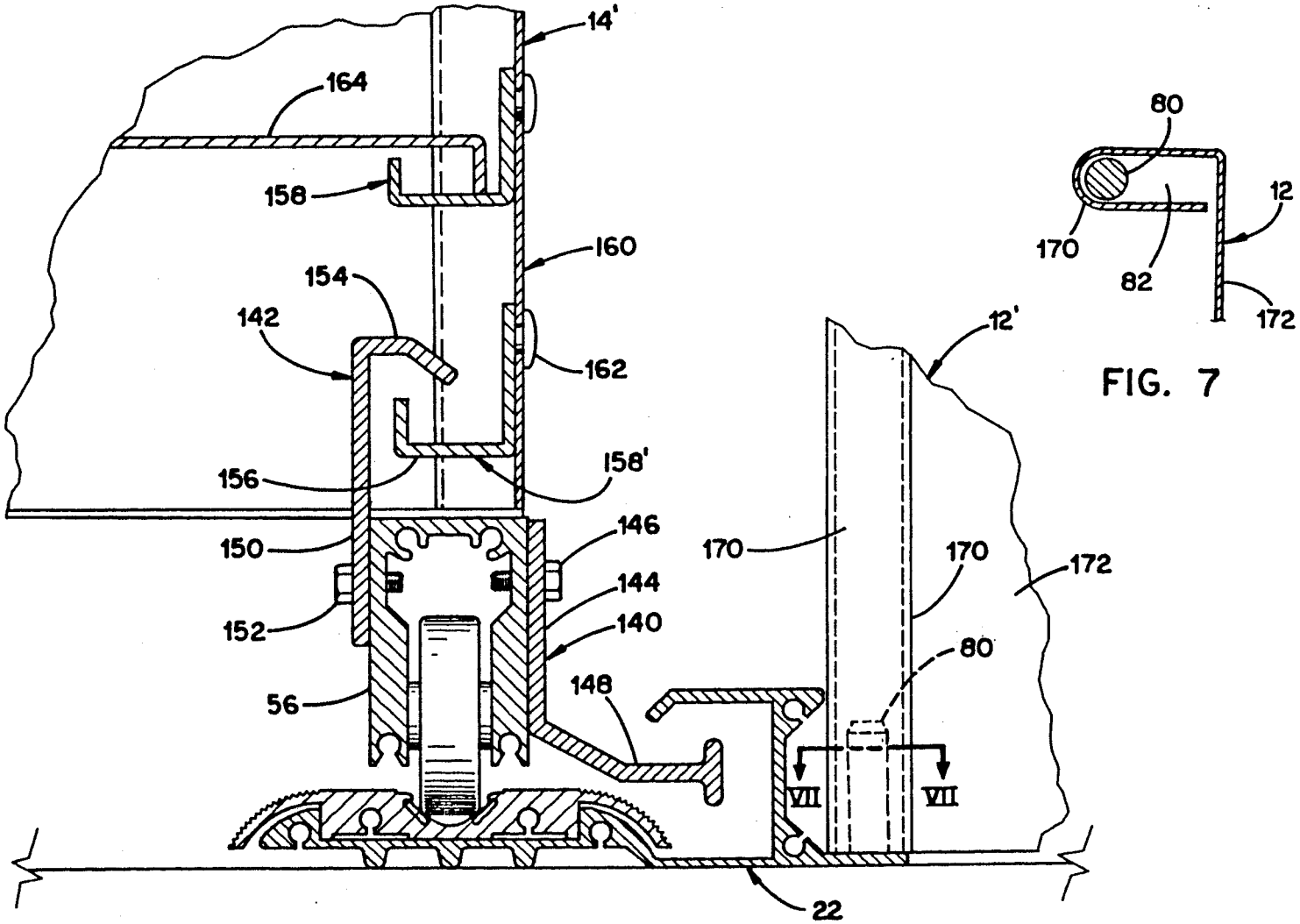
FIG. 6 is a sectional view similar to FIG. 2 showing an alternate embodiment of the system according to the invention.
FIG. 7 is a sectional view taken along the line VII—VII of FIG. 2.

The portion of the anti-tip underlayment base 42 extending rearwardly of the vertical wall 74 forms a longitudinally extending foot 42. The forward bottom support 30 of the fixed shelving unit 12 rests upon foot 42. Thus, the force of gravity acting on the fixed shelving unit 12 causes the anti-tip underlayment to be held tightly down against the floor F, especially when fixed shelving unit 12 is loaded with files or other items. The foot 42 is provided with upstanding pins 80 which pass through corresponding recesses 82 formed in the forward bottom support 30. As shown in FIG. 7, the recess 82 is formed by a vertical wall portion 170 which turns back toward the end wall 172 of the fixed shelving unit. Preferably, pins 80 are provided to mate with the fixed shelving unit bottom supports at each forward corner of each fixed shelving unit.

As shown in FIG. 3, a rubber stop 81 is affixed to the vertical wall 74 of the anti-tip underlayment disposed within the recess 78 near each end of the underlayment. The stop 81 prevents movement of the carriage beyond the end of the tracks. An end plate 85 covers each end of the anti-tip underlayment, affixed thereto by screws 87 inserted through holes in the end plate and engaging recesses such as recess 89 formed in the underlayment.

The portion of the anti-tip underlayment base 42 extending forwardly of the vertical wall 74 forms a longitudinally extending arm 84. Thus, the anti-tip retainer 73 including wall 74 and retainer flange 76 is disposed intermediate the foot portion 42 and the arm portion 84. The forwardmost extent of the arm is formed with a longitudinal depression 86 dimensioned to snugly receive the central body 64 of the track 20. In this manner the track 20 is held in correct, parallel alignment with the fixed shelving unit 12 spaced forwardly of the fixed shelving unit at the correct distance. Accordingly, the arrangement is self-aligning.

As shown in FIG. 2, forward track 18 is installed resting upon a track underlayment 90 which serves to raise track 18 to the same elevation as rear track 20. Track underlayment 90 is formed as an elongated member, preferably of extruded aluminum, having upstanding edge walls 92, 94 forming a depression 86 therebetween in which rests the central body 64 of track 20. With the rearward rollers such as roller 62 of the carriage engaged in the groove of the rear track 20, the engagement of the forward rollers such as roller 60 with the groove of the forward track 18 serves to align and space the forward track correctly with respect to the rearward track.

The undersides of the anti-tip underlayment arm 84 and the track underlayment 90 are formed with longitudinal ribs 96, 98 which serve as stiffeners. Furthermore, when the system is installed on a carpet floor, the ribs bite into the carpeting somewhat and prevent the components from moving out of position. It should be noted that the underlayments and tracks merely rest upon the floor without the need for fasteners such as screws or nails driven into the floor. However, if desired, such floor fasteners may be used.

As shown in FIGS. 2 and 4, a carriage rail retainer 54 is affixed to the rear longitudinal rail 56 of the carriage 16. The carriage rail retainer is formed as an elongated member, preferably of extruded aluminum, having a generally vertical wall portion 102 overlying the rear surface of rail 56 and affixed thereto by fasteners such as bolts or Allen head screws 105. The carriage rail retainer is generally coextensive in length with the rail 56, extending longitudinally between the corner plates 63 at each end thereof.

From the lower edge of the vertical wall portion 102 of the carriage rail retainer 54, a retainer finger 106 extends rearwardly, terminating in a vertically widened rearward edge 108. The rearward edge 108 of the retainer finger is received within the recess 78 of the anti-tip retainer 73.

From the upper edge of the vertical wall portion 102 of the carriage retainer 54, a horizontal wall portion 52 extends forwardly, overlying the upper surface of the rear longitudinal rail 56. From the forward edge of the horizontal wall portion 52, an L-shaped flange 110 extends upwardly and rearwardly. A shelf support bracket 158' is attached to the rear of the mobile shelving unit 14 near the bottom support 32. The ledge 164' of the bracket 158' extends forwardly under the flange 110. Thus bracket 158' provides an engagement element for engaging the flange 110 upon forward tipping of the shelving unit. A lip 112 extends downwardly from the forward edge of the horizontal wall portion to cooperate with the vertical wall portion 102 to straddle the rail 56.

Engagement elements other than shelf brackets 158' may be employed The lower extent of the mobile shelving unit may be constructed with flanges or feet suitable for engagement with the flange 110. Furthermore, flange 110 may be connected directly to the shelving unit such as by screws inserted through mating surfaces.

Thus, it may be seen in FIG. 2 that if the mobile shelving unit 14 is tipped forwardly, away from the fixed shelving unit 12, the shelf bracket 158' will engage the flange 110 of the carriage rail retainer 54. Upon further tipping, the carriage retainer and the rail 56 will also be lifted. After a small amount of lifting, the retainer finger 106 contacts the retainer flange 76. The weight of the fixed shelving unit 12 upon the anti-tip underlayment 22 and the engagement of the finger 106 with the retainer flange 76 prevents further forward tipping of the mobile shelving unit 14. Rearward tipping of the mobile shelving unit is prevented by contact between the upper extents of the mobile shelving unit and the fixed shelving unit.

The lateral mobile storage system of the invention is advantageously provided in modular fashion by forming the track sections and anti-tip underlayments in lengths approximately equal to integral multiples of the lengths of the shelving units. For example, as shown in FIG. 1, the tracks sections **18*a*, 18*b* are approximately equal in length to the length of the fixed shelving unit 14, while the anti-tip underlayment is approximately equal in length to the combined lengths of fixed shelving units 12 and 12*a***.

Where collinear track sections are joined end-to-end, as at 120 (FIG. 1), the invention provides a convenient means for forming a secure connection. As shown in FIG. 5, track sections **18*a* and 18*b* are brought into end-to-end adjacency. Splice plates 122 are provided as narrow strips of metal having a hole 124 formed through each end. Holes or bores 126 are formed in the central bodies 64 of the track sections disposed on either side of the groove 66. Bores 126 are spaced inwardly from the ends of the track sections such that when the tracks are joined the distance between corresponding pairs of bores is equal to the distance between the holes 124 of the splice plate 122. Screws 128 are inserted through the holes 124 and tightened in the bores 126. Normally, a splice plate is installed on both sides of the track groove 66. Alignment pins 130 are frictionally inserted in co-aligned longitudinal recesses 132 in the track section ends. Thus, only common tools such as an Allen wrench or screwdriver are required to splice track sections. The splice plates do not interfere with the motion of the carriage, nor do they prevent the proper seating of the track sections on the anti-tip underlayment arm 84 or on the track underlayment 90**.

Figure 8:
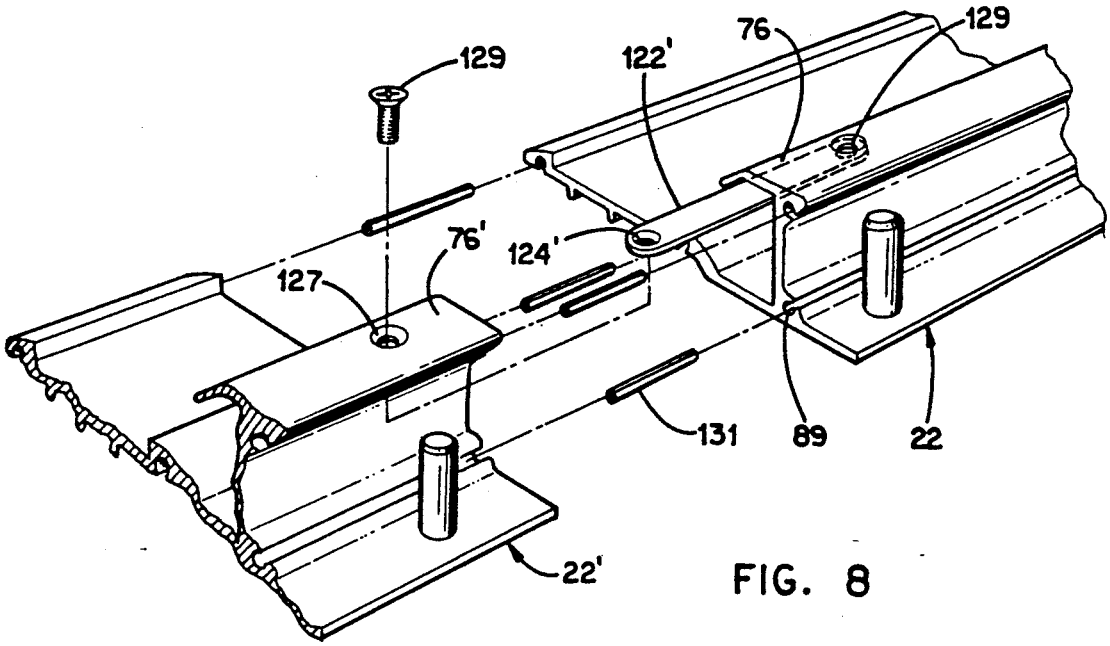
FIG. 8 is an exploded, fragmentary, perspective view showing a splice between anti-tip underlayment ends.

As shown in FIG. 8, the anti-tip underlayment, when provided in multiple sections, may be spliced in a similar manner by the use of pins 131 in recesses such as recess 89 in the underlayment sections 22, 22'. Splice plates 122' are used bridging under the flanges 76, 76'. Screws 129 are inserted through holes such as hole 127 formed through the flanges 76, 76' near their ends and into corresponding holes such as hole 124' formed through the ends of the splice plate 122'.

The lateral mobile storage system of the invention may be assembled and installed as follows: First, the fixed shelving units 12, **12*a* are assembled and placed in their approximate final location with shims in place under the bottom rear of each fixed shelving unit. Each fixed shelving unit is tipped rearwardly to raise the bottom front off the floor. Anti-tip underlayments are spliced, if necessary, using pins and splice plates 122'. The anti-tip underlayment 22 is positioned with the foot 42 under the bottom front of the fixed shelving unit or units with the pins 80 brought into alignment with the recesses 82 in the bottom of the fixed shelving unit. The fixed shelving units are then returned to vertical thus engaging the pins 80**. The fixed shelving units are moved into their final position.

Next, the rearward track section or sections for the mobile shelving unit or units are placed on the arm 84 of the anti-tip underlayment with the central bodies 64 of the track sections received in the depression 86. Track section ends are spliced using splice plates 122, and pins 130 if necessary. The track underlayment section or sections 90 are placed in approximate position forwardly of the rear track. The forward track section or sections are placed on the track underlayment and are spliced if necessary. The carriage 16 with the carriage retainer 54 affixed is positioned with its rearward rollers in the groove of the rear track. The position of the forward track is adjusted into alignment with the forward rollers of the carriage, then the forward rollers are placed in the groove of the forward track. The mobile shelving unit is assembled and placed upon the carriage, with care being taken to see that the lower rear portion of the mobile shelving unit is correctly positioned with respect to the flange 110 of the carriage retainer. Additional carriages and mobile shelving units are installed as desired.

An alternate construction of the mobile storage system according to the invention is shown in FIG. 6. In this embodiment, a carriage rail retainer 140 and a shelving unit retainer 142 are provided as separate elements rather than as an unitary member. The carriage rail retainer 140 is formed as a generally L-shaped elongated member having a vertical portion 144 overlying the rear surface of the carriage rail and affixed thereto by Allen head screw or bolt 146. The carriage rail retainer further has a finger 148 extending rearwardly into the recess of the anti-tip underlayment 22 in the same manner as finger 106 of FIG. 2

Shelving unit retainer 142 is a generally inverted J-shaped member having a vertical wall portion 150 overlying the forward surface of the carriage rail 56 and affixed thereto by screw or bolt 152. The shelving unit retainer 142 extends upwardly with a hook-like flange 154 overhanging the forwardly extending flange 156 of shelf bracket 158'.

Figure 9:
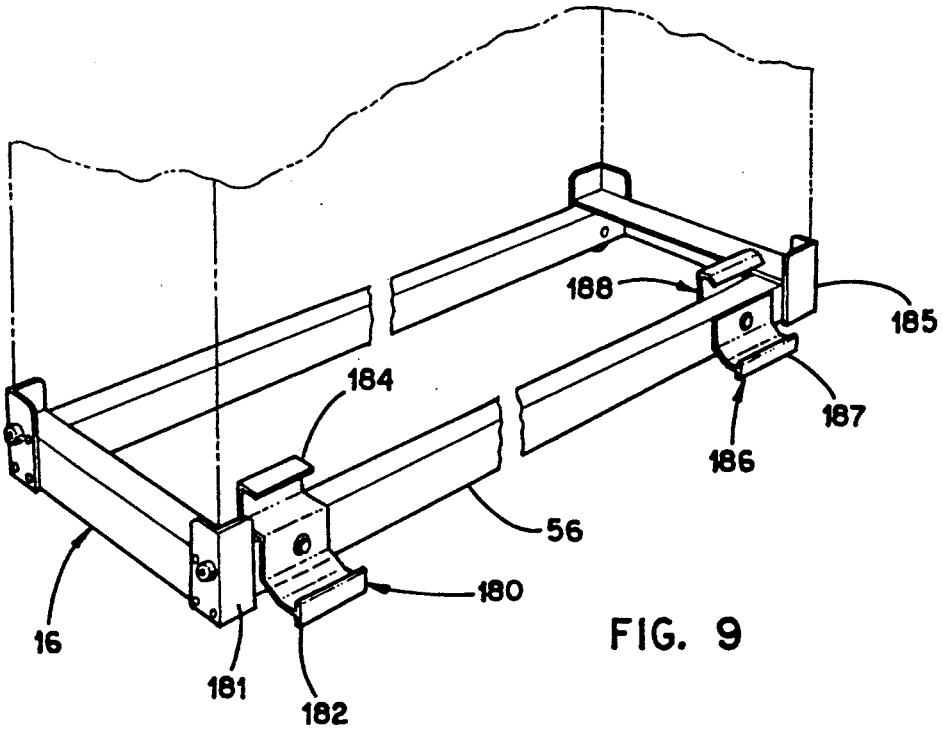
FIG. 9 is similar to FIG. 4, but showing alternate embodiments of the invention.

The carriage rail retainers 54 and 140 of FIG. 2 and 6, and the shelving unit retainer 142 need not extend continuously along substantially the entire length of the carriage 16. Alternatively, these elements may be provided as two or more relatively short sections. As shown at the left side of FIG. 9, unitary carriage rail retainer has a cross-section similar to carriage rail retainer 54 of FIG. 2 yet extends only a short longitudinal distance along the rail 56 adjacent the carriage corner 181. Like carriage rail retainer 54, retainer 180 includes a finger 182 for engaging the anti-tip underlayment and a flange 184 for engaging the mobile shelving unit and retaining it on the carriage 16. At the right side of FIG. 9, near the corner 185 of the carriage, a relatively short carriage retainer 186 with finger 187 and a relatively short shelving unit retainer 188 are affixed to the rail 56 in a manner similar to that shown in FIG. 6. It should be understood that in a usual installation the same type of short retainer element would be used at both ends of the carriage rail. If desired, additional retainer elements may be used spaced at intervals along the length of the rail.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. An anti-tip mobile storage system comprising:

at least one fixed storage unit having a front and a back, said front disposed forwardly of said back, said back disposed rearwardly of said front;

at least one mobile storage unit disposed forwardly of said front of said fixed storage unit;

a first track disposed forwardly of said front of said fixed storage unit and a second track disposed forwardly of said first track;

carriage supported on said tracks and movably carrying said mobile storage unit longitudinally along said first and second tracks;

an underlayment having a base supported by a supporting surface, said underlayment being elongated in the direction of movement of said carriage and having a foot extending rearwardly form aid base and under said front of said fixed storage unit with the weight of said fixed storage unit bearing down on said foot, an arm extending forwardly form said base under said first track, and a longitudinal anti-tip retainer disposed forwardly of said fixed storage unit and rearwardly of said mobile storage unit;

an underlayment engagement fixed to said carriage and extending rearwardly from said carriage, said underlayment engagement cooperatively engaging said longitudinal anti-tip retainer to arrest tipping of said mobile storage unit; and means for retaining said mobile storage unit on said carriage;

whereby said underlayment engagement engages said longitudinal anti-tip retainer when said mobile storage unit is tipped forwardly away form said fixed storage unit.

2. The storage system of claim 1 wherein said longitudinal anti-tip retainer comprises a longitudinal recess and said underlayment engagement comprises a finger extending into said recess.

3. The storage system of claim 2 wherein said underlayment engagement further comprises a member having a generally vertically extending wall portion fixed to said carriage and wherein said finger extends generally horizontally from said wall portion.

4. An anti-tip lateral mobile storage mobile storage system comprising:

at least one longitudinally extending fixed storage unit having a front and a back, said front disposed forwardly of said back, said back disposed rearwardly of said front;

at least one longitudinally extending mobile storage unit disposed forwardly of said front of said fixed storage unit;

a longitudinally extending first track disposed forwardly of said front of said fixed storage unit and a longitudinally extending second track disposed forwardly of said first track for movement of said mobile storage unit therealong;

a carriage supported on said tracks for rollingly carrying said mobile storage unit along said tracks;

an underlayment having a longitudinally elongated base supported on a floor, said base including a foot portion extending rearwardly form said base and underlying said fixed storage unit, the weight of said fixed storage unit bearing on said foot portion, said base further including an arm portion extending forwardly from said base and underlying said first track, and a retainer flange spaced apart form said base intermediate said foot portion and said arm portion forming a longitudinal recess;

a carriage retainer fixed to said carriage and having a finger extending rearwardly into said recess of said underlayment, said finger contacting said retainer flange upon forward tipping of said carriage away from said fixed storage unit; and means for retaining said mobile storage unit on said carriage.

5. The storage system of claim 4 further comprising means on said foot portion for engaging said fixed storage unit and aligning said underlayment therewith.

6. The storage system of claim 5 wherein said means on said foot portion for engaging said fixed storage unit comprises an upstanding pin on said foot portion, and a recess formed in said fixed storage unit, said pin engaging said fixed storage unit recess.

7. The storage system of claim 4 wherein said underlayment arm portion includes means for engaging said rearward track and maintaining said rearward track in proper alignment with said fixed storage unit.

8. The storage system of claim 7 wherein said first track comprises at least one track section having a longitudinal central body and said underlayment arm portion is formed with a longitudinal depression receiving said central body.

9. The storage system of claim 4 further comprising a track underlayment disposed underlying said second track for supporting said forward track at the same elevation as said rearward track.

10. The storage system of claim 4 wherein said carriage retainer and said means for retaining said mobile storage unit on said carriage comprise a unitary carriage retainer member.

11. The storage system of claim 10 wherein said unitary carriage retainer member includes a generally horizontally extending wall portion joining said carriage retainer and said mobile storage unit retainer, said carriage comprising a rearward longitudinal rail, said horizontal wall portion disposed surmounting said carriage rearward longitudinal rail, said carriage retainer and said mobile storage retainer disposed straddling said rearward longitudinal rail.

12. The storage system of claim 4 wherein said underlayment further comprises a stop means disposed within said longitudinal recess near an end thereof for limiting longitudinal travel of said carriage.

13. The storage system of claim 4 wherein said first and second tracks and said underlayment are provided as a plurality of collinear, end-to-end sections, each section having a length substantially equal to an integral multiple of the length of said mobile storage unit.

14. The storage system of claim 13 further including splice means for maintaining said sections in end-to-end relationship.

15. The storage system of claim 14 wherein said splice means comprises at least one longitudinal extending splice plate spanning across adjacent end portions of said sections and fastener means for affixing said splice plate to said sections.

16. An anti-tip mobile storage system comprising:

at least one fixed storage unit having a front and a back, said front disposed forwardly of said back, said back disposed rearwardly of said front;

at least one mobile storage unit disposed forwardly of said front of said fixed storage unit;

a first track disposed forwardly of said front of said fixed storage unit and a second track disposed forwardly of said first track;

a carriage movably carrying said mobile storage unit longitudinally along said first and second tracks, said mobile storage unit having a bottom supported on said carriage;

an underlayment having a base supported by a supporting surface, said underlayment being elongated in the direction of movement of said carriage and having a foot extending rearwardly from said base and under said front of said fixed storage unit with the weight of said fixed storage unit bearing down on said foot, an arm extending forwardly form said base under said first track, and a longitudinal anti-tip retainer disposed forwardly of said fixed storage unit and rearwardly of said mobile storage unit, said longitudinal anti-tip retainer comprising a longitudinal recess;

an underlayment engagement fixed to said carriage and cooperatively engaging said longitudinal anti-tip retainer to arrest tipping of said mobile storage unit, said underlayment engagement comprising a member having a generally vertically extending wall portion fixed to said carriage and a finger extending generally horizontally from said wall portion into said recess; and means for retaining said mobile storage unit on said carriage comprising a member having a generally vertically extending wall portion extending upwardly form said carriage and a flange overhanging the bottom of said mobile storage unit.

17. The storage system of claim 11 wherein said underlayment engagement and said means for retaining said mobile storage unit on said carriage comprise a unitary member affixed to said carriage.

18. The storage system of claim 17 wherein said unitary member extends along substantially the entire length of said carriage.

19. The storage system of claim 16 wherein said underlayment engagement and said means for retaining said mobile storage unit on said carriage each comprise relatively short members disposed longitudinally spaced apart.

20. An anti-tip mobile storage system comprising:

at least one fixed storage unit having a front and a back, said front disposed forwardly of said back, said back disposed rearwardly of said front;

at least one mobile storage unit disposed forwardly of said front of said fixed storage unit;

a first track disposed forwardly of said front of said fixed storage unit and a second track disposed forwardly of said first track;

a carriage movably carrying said mobile storage unit longitudinally along said first and second tracks;

an underlayment having a base supported by a supporting surface, said underlayment being elongated in the direction of movement of said carriage and having a foot extending rearwardly from said base and under said front of said fixed storage unit with the weight of said fixed storage unit bearing down on said foot, an arm extending forwardly form said base under said first track, and a longitudinal anti-tip retainer disposed forwardly of said fixed storage unit and rearwardly of said mobile storage unit, and means for engaging said fixed storage unit and positioning said underlayment and said first track in proper alignment with said fixed storage unit;

an underlayment engagement fixed to said carriage and cooperatively engaging said longitudinal anti-tip retainer to arrest tipping of said mobile storage unit; and means for retaining said mobile storage unit on said

21. The storage system of claim 20 wherein said means for engaging said fixed storage unit and positioning said underlayment and said first track in proper alignment with said fixed storage unit comprises a pin extending upwardly from said underlayment and engaging a recess formed in said fixed storage unit.

22. The storage system of claim 20 wherein said first track comprises at least one track section having a longitudinal central body and said arm includes means for engaging said central body and maintaining said track section in proper alignment with said fixed storage unit.

* * * * *

UNITED STATES PATENT AND TRADEMARK OFFICE

CERTIFICATE OF CORRECTION

PATENT NO. : 5,205,627

DATED : April 27, 1993

INVENTOR(S) : Davison et al.

It is certified that error appears in the above-identified patent and that said Letters Patent is hereby corrected as shown below:

TITLE PAGE, ITEM [73],
Assignee:
"Ripp" should be --Pipp--

Column 8, Claim 1, Line 9:
insert "a" before --carriage--

Column 8, Claim 1, Line 15:
"form aid" should be --from said--

Column 8, Claim 1, Line 18:
"form" should be --from--

Column 8, Claim 4, Line 61:
"form" should be --from--

Column 8, Claim 4, Line 66:
"form" should be --from--

Column 9, Claim 15, Line 56:
"longitudinal" should be --longitudinally--

UNITED STATES PATENT AND TRADEMARK OFFICE

CERTIFICATE OF CORRECTION

PATENT NO. : 5,205,627

DATED : April 27, 1993

INVENTOR(S) : Davison et al.

It is certified that error appears in the above-identified patent and that said Letters Patent is hereby corrected as shown below:

Column 10, Claim 16, Line 11:
"form" should be --from--

Column 10, Claim 20, Line 60:
"form" should be --from--

Column 11, Claim 20, Line 3:
after "said" insert -carriage.--

Signed and Sealed this

Fourth Day of January, 1994

*Attest:*

Bruce Lehman

BRUCE LEHMAN

*Attesting Officer*

*Commissioner of Patents and Trademarks*